US010799946B2

(12) United States Patent
Adams et al.

(10) Patent No.: US 10,799,946 B2
(45) Date of Patent: Oct. 13, 2020

(54) DIE CASTING DIE WITH REMOVABLE INSERTS

(71) Applicants: MAGNA INTERNATIONAL INC., Aurona, Ontario (CA); Kenneth Ray Adams, Oakland Township, MI (US); Peter Joseph Bertolini, Grosse Pointe Woods, MI (US); Peter Michael Littkemann, Windsor (CA)

(72) Inventors: Kenneth Ray Adams, Oakland Township, MI (US); Peter Joseph Bertolini, Grosse Pointe Woods, MI (US); Peter Michael Littkemann, Windsor (CA)

(73) Assignee: MAGNA INTERNATIONAL INC., Aurora (CA)

( * ) Notice: Subject to any disclaimer, the term of this patent is extended or adjusted under 35 U.S.C. 154(b) by 183 days.

(21) Appl. No.: 16/075,138

(22) PCT Filed: Feb. 6, 2017

(86) PCT No.: PCT/US2017/016712
§ 371 (c)(1),
(2) Date: Aug. 2, 2018

(87) PCT Pub. No.: WO2017/142731
PCT Pub. Date: Aug. 24, 2017

(65) Prior Publication Data

US 2018/0369904 A1 Dec. 27, 2018

Related U.S. Application Data

(60) Provisional application No. 62/296,231, filed on Feb. 17, 2016.

(51) Int. Cl.
*B22D 17/22* (2006.01)
*B22C 3/00* (2006.01)
*B22D 17/08* (2006.01)

(52) U.S. Cl.
CPC ..... *B22D 17/229* (2013.01); *B22C 3/00* (2013.01); *B22D 17/08* (2013.01); *B22D 17/22* (2013.01);
(Continued)

(58) Field of Classification Search
CPC ..... B22D 17/229; B22D 17/08; B22D 17/22; B22D 17/2209; B22D 17/2218; B22C 3/00
See application file for complete search history.

(56) References Cited

U.S. PATENT DOCUMENTS 3,431,601 A * 3/1969 Lipscomb ..... B22C 7/005 425/195
4,704,079 A 11/1987 Pluim, Jr.
(Continued)

FOREIGN PATENT DOCUMENTS

CN 2590706 Y 12/2003
CN 1708369 A 12/2005
(Continued)

OTHER PUBLICATIONS

"Dyna-Blue Ferritic Nitrocarburizing" https://www.youtube.com/watch?reload=9&v=2NqVkdw9YJM. May 13, 2013. (Year: 2013).*
(Continued)

*Primary Examiner* — Kevin P Kerns
*Assistant Examiner* — Steven S Ha
(74) *Attorney, Agent, or Firm* — Dickinson Wright PLLC

(57) ABSTRACT

A die casting apparatus for manufacturing metal parts for automotive vehicle applications is provided. The die casting apparatus includes upper and lower dies presenting forming
(Continued)

surfaces and a mold cavity therebetween. A replaceable insert and sub-inserts provide portions of the forming surfaces of the dies in areas most prone to wear and erosion. The replaceable inserts and sub-inserts can be removed and replaced during high volume production, without having to replace the entire die. A wear and/or heat resistant coating can be applied to the inserts and sub-inserts to further increase service life. A plurality of cooling channels can also be formed in the inserts and sub-inserts to improve cycle time and quality of the parts.

20 Claims, 5 Drawing Sheets

(52) U.S. Cl.
CPC ..... *B22D 17/2209* (2013.01); *B22D 17/2218* (2013.01)

(56) References Cited

U.S. PATENT DOCUMENTS

| | | | | |
|---|---|---|---|---|
| 5,522,448 | A * | 6/1996 | Righi ..... | B22D 17/2218 164/122 |
| 6,427,755 | B1 | 8/2002 | Buckley | |
| 7,401,636 | B2 | 7/2008 | O'Donnell et al. | |
| 7,587,919 | B1 | 9/2009 | Young | |
| 2003/0150586 | A1 | 8/2003 | Matsuura | |
| 2005/0274481 | A1 | 12/2005 | O'Donnell et al. | |
| 2009/0260773 | A1 | 10/2009 | Yoshii et al. | |
| 2011/0127403 | A1 | 6/2011 | Furukawa et al. | |
| 2013/0042992 | A1 | 2/2013 | Hiraoka et al. | |
| 2016/0201650 | A1 | 7/2016 | Okazaki et al. | |

FOREIGN PATENT DOCUMENTS

| | | | |
|---|---|---|---|
| CN | 101242923 | A | 8/2008 |
| CN | 201855936 | U | 6/2011 |
| DE | 102005024768 | A1 | 11/2006 |
| DE | 102006002342 | A1 | 7/2007 |
| DE | 102007054723 | B4 | 5/2015 |
| IE | 102007054723 | A1 | 5/2009 |
| WO | 2014130245 | A1 | 8/2014 |

OTHER PUBLICATIONS

CN Office Action for corresponding CN Application No. 201780011508.3 dated Dec. 24, 2019 with English translation.
Supplemental Europoean Search Report from corresponding EP Application No. 17753646.3 dated Aug. 19, 2019.

* cited by examiner

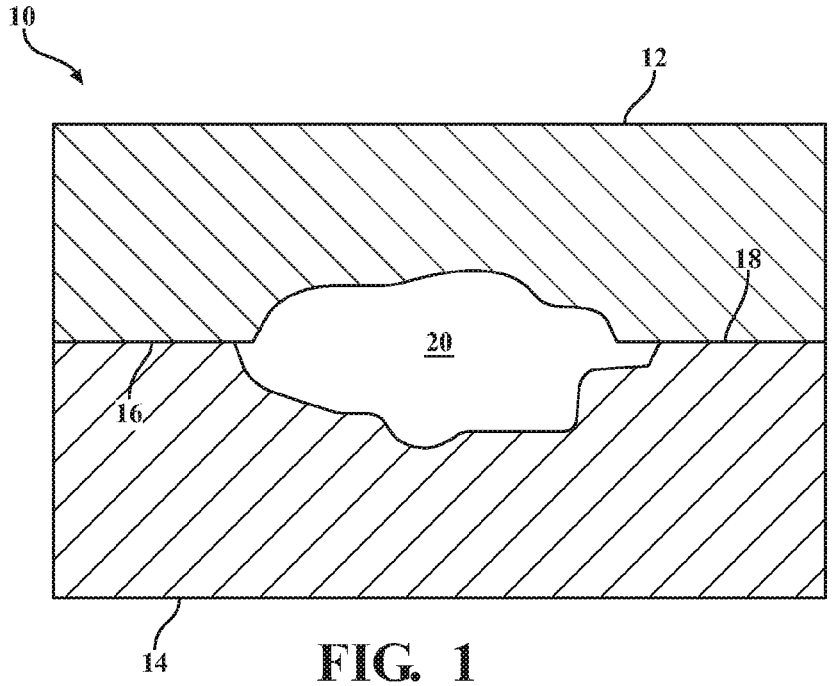
FIG. 1
FIG. 2
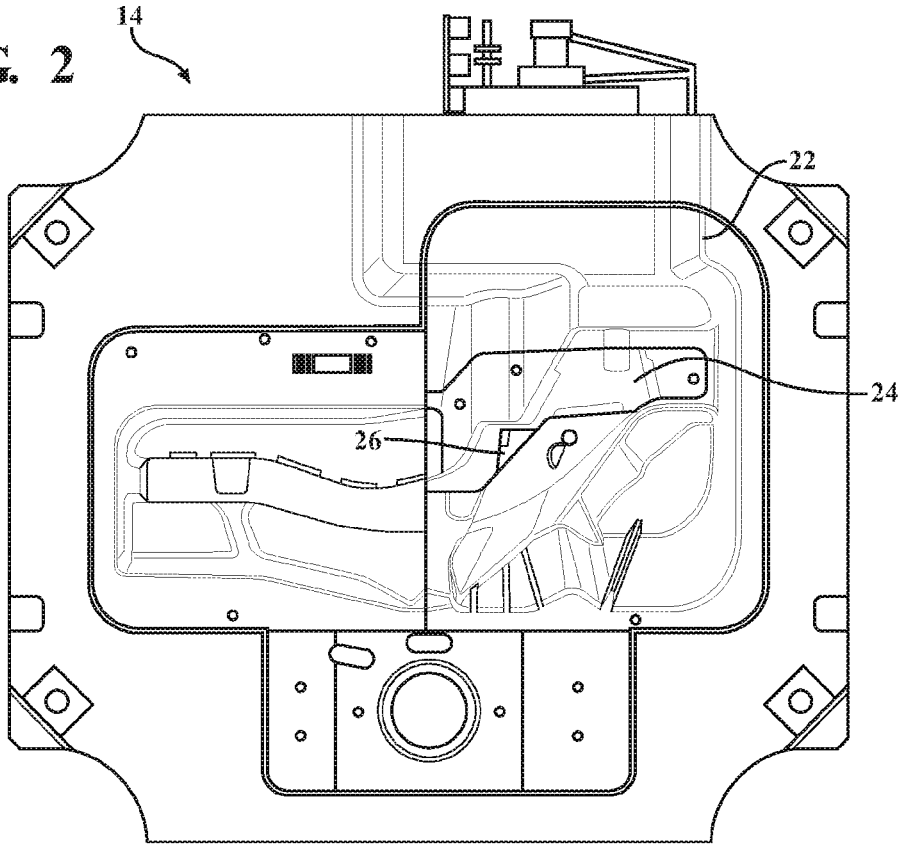

DIE CASTING DIE WITH REMOVABLE INSERTS

CROSS REFERENCE TO RELATED APPLICATIONS

This U.S. National Stage Patent Application claims the benefit of PCT International Patent Application Serial No. PCT/US2017/016712 filed Feb. 6, 2017 entitled "Die Casting Die With Removable Inserts" which claims the benefit of U.S. Provisional Patent Application Ser. No. 62/296,231 filed on Feb. 17, 2016 entitled "Die Casting Die With Removable Inserts," the entire disclosures of the applications being considered part of the disclosure of this application and hereby incorporated by reference.

BACKGROUND OF THE INVENTION

1. Field of the Invention

The invention relates generally to a die casting apparatus for manufacturing metal parts, such as parts for automotive applications, a method for manufacturing the die casting apparatus, and a method for manufacturing metal parts using the die casting apparatus.

2. Related Art

Die casting is oftentimes used to form metal parts having various shapes, for example parts used in automotive vehicle applications, such as pillars, headers, rails, twist axles, spring links, control arms, bumpers, beams, side panels, or any other type of strength driven chassis component, body in white component, or safety-related component. The die casting process includes forcing molten metal into a mold cavity under high pressure. The mold cavity is located between an upper die and a lower die which are typically formed of hardened tool steel. Each die presents a forming surface having a shape depending on the geometry of the part to be formed.

Over time, the forming surfaces of the dies can experience significant erosion and wear due to the high temperatures and harsh conditions of the casting process. Certain areas of the forming surfaces are more prone to wear, depending on the process conditions and geometry of the part being formed. Typically, both dies must be replaced after about 60,000 to 70,000 casting cycles due to wear and erosion along the forming surfaces, which increases production time and costs.

SUMMARY

The invention provides a die casting apparatus for manufacturing metal parts, such as parts used in automotive vehicle applications. The die casting apparatus includes an upper die and a lower die providing a mold cavity therebetween, and each of the dies presents a forming surface. At least one of the dies includes at least one insert and at least one sub-insert each presenting a portion of the forming surface. The at least one insert and the at least one sub-insert are removable from the dies and replaceable. The at least one insert and sub-insert are typically disposed in locations prone to wear. Since the inserts and sub-inserts can be removed and replaced after significant wear, it is no longer necessary to replace the entire die during high volume production. Thus, the least one insert and sub-insert improve service life of the die casting apparatus and reduce production time and costs.

Another aspect of the invention is a method of manufacturing a die casting apparatus for manufacturing metal parts. The method includes providing an upper die and a lower die with a mold cavity therebetween, wherein each of the dies present a forming surface. The method further includes disposing at least one insert and at least one sub-insert in at least one of the dies, wherein the at least one insert and the at least one sub-insert present a portion of the forming surface. The method also includes removing the at least one insert and/or the at least one sub-insert from the dies after about 60,000 casting cycles; and replacing the at least one insert and/or the at least one sub-insert after removing from the dies.

Yet another aspect of the invention provides a method of manufacturing metal parts. The method includes casting a plurality of metal parts in a die casting apparatus, wherein the die casting apparatus includes an upper die and a lower die providing a mold cavity therebetween, each of the dies present a forming surface, and at least one of the dies includes at least one insert and at least one sub-insert each presenting a portion of the forming surface. The method also includes removing the at least one insert and/or the at least one sub-insert from the dies after about 60,000 casting cycles; and replacing the at least one insert and/or the at least one sub-insert after removing the at least one insert and/or the at least one sub-insert from the dies.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 1 is a side cross-section view of a die casting apparatus according to an example embodiment;

FIG. 2 illustrates a rear rail casting die including a replaceable insert and two sub-inserts according to an example embodiment;

DETAILED DESCRIPTION OF EXAMPLE EMBODIMENTS

Figure 3:
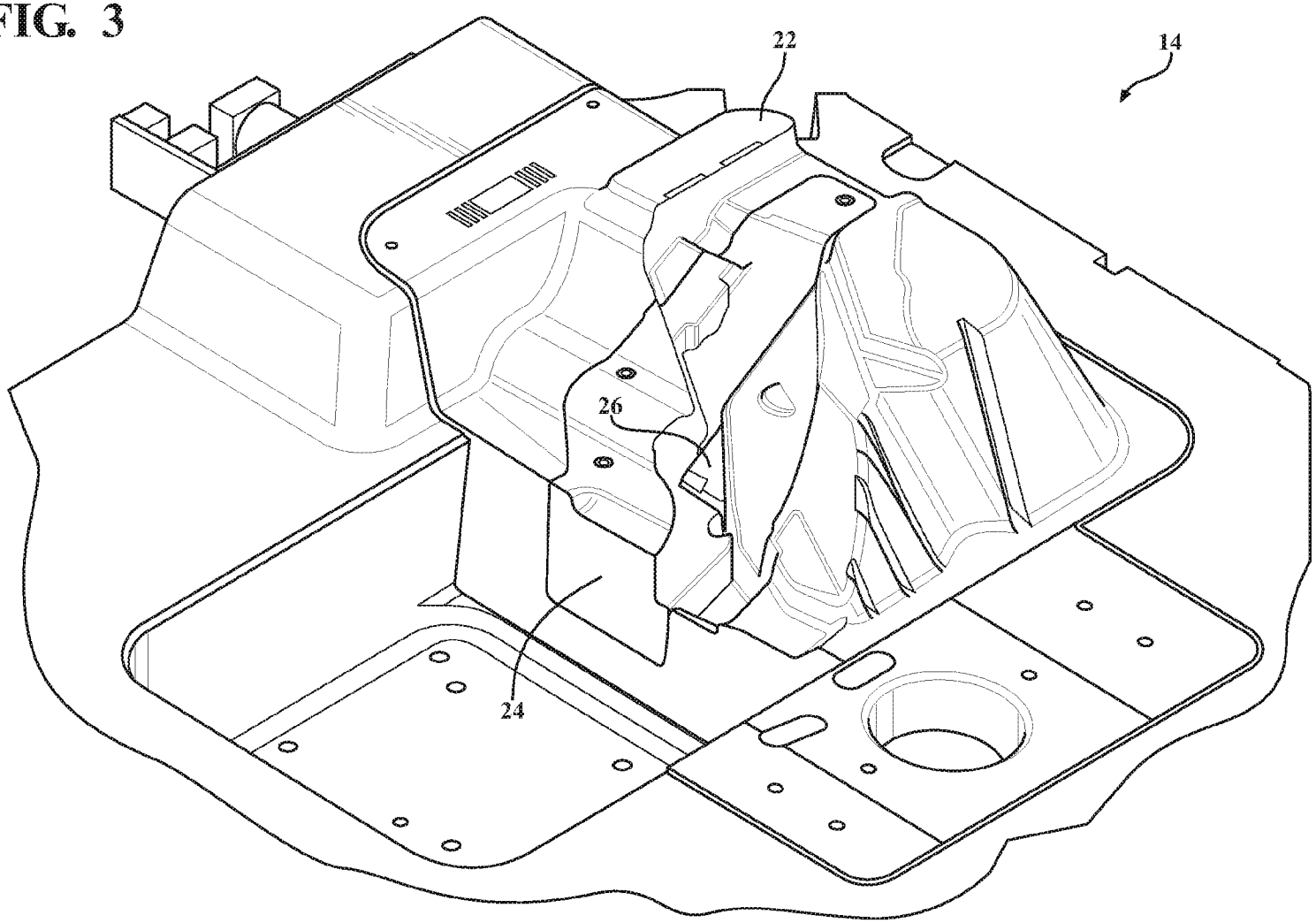
FIG. 3 illustrates a perspective view of the rear rail casting die of FIG. 2 and including a cross-section of the replaceable insert and sub-inserts.

The invention provides a die casting apparatus 10 for manufacturing metal parts having various shapes, such as parts used in automotive vehicle applications. Examples of parts that can be formed using the die casting apparatus 10 include pillars, headers, rails, twist axles, spring links, control arms, bumpers, beams, side panels, strength driven chassis components, body in white components, and safety-related components. The die casting apparatus 10 includes an upper die 12 and a lower die 14 each having a forming surface 16, 18 to provide a mold cavity 20 therebetween. The forming surfaces 16, 18 can have various different shapes, depending on the part to be formed. FIGS. 2, 3, 5, and 6 illustrate the lower casting die 14 according to an example embodiment which is designed to form a rear rail of an automotive vehicle.

At least one of the casting dies 12, 14 of the die casting apparatus 10 includes at least one replaceable insert 22. The insert 22 provides at least a portion of the forming surface 18 which shapes the molten metal into the geometry of the part to be formed. The replaceable insert 22 is typically located in an area prone to wear and/or erosion during the casting process. Thus, the shape and size of the insert 22 typically vary in each case. The replaceable insert 22 has a surface area along the forming surface 18 and also a thickness extending from the forming surface 18 into the die 12, 14. In the example embodiment shown in the Figures, the lower die 14 includes one insert 22 providing a significant portion of the forming surface 18. The insert 22 can be formed of the same material used to form the casting die 14, for example steel, or a different material, such as another metal.

At least one of the casting dies 12, 14 of the die casting apparatus 10 can also include at least one sub-insert 24, 26. Each sub-insert 24, 26 is located along the insert 22 or along another sub-insert 24, 26. The sub-inserts 24, 26 also provide a portion of the forming surface 16, 18. The sub-inserts 24, 26 are typically located in areas even more prone to wear and/or erosion during the casting process than the inserts 22. Thus, the shape and size of the sub-inserts 24, 26 typically vary in each case. The sub-inserts 24, 26 have a surface area along the forming surface 18 and also a thickness extending from the forming surface 18 into the die 12, 14. In the example embodiment shown in the Figures, two sub-inserts 24, 26, are located along the insert 22 and are surrounded by the insert 22. The first sub-insert 24 extends longitudinally though a center portion of the insert 22 to an edge of the insert 22. The surface area of the first sub-insert 24 is less than the surface area of the insert 22. The second sub-insert 26 is disposed along a small region of the first sub-insert 24, and the surface area of the second sub-insert 26 has a triangular shape. The surface area of the second sub-insert 26 is less than the surface area of the first sub-insert 24. In the example embodiment, the total surface area provided by the sub-inserts 24, 26 is less than the surface area provided by the one insert 22. The total surface area of all of the sub-inserts 24, 26 is typically less than the total surface area of all of the inserts 22 in the dies 12, 14. The sub-inserts 24, 26 can be formed of the same material used to form the casting die 14 and/or the inserts 22 for example steel, or a different material, such as another metal.

As mentioned above, the forming surfaces 16, 18 of the casting dies 12, 14 are typically subject to significant wear and/or erosion during high volume production. Comparative casting dies are typically replaced after about 60,000 to 70,000 casting cycles due to such wear and erosion. However, in the present case, only inserts 22 and sub-inserts 24, 26 located in the areas most prone to wear need to be replaced. The inserts 22 and sub-inserts 24, 26 can be easily removed and replaced without having to replace the entire die 14. This leads to reduced cycle time, reduced production costs, and increased quality of the parts formed, particularly during high volume production.

Optionally, a wear and/or heat resistant coating can be applied to the inserts 22 and/or sub-inserts 24, 26 to further increase service life to 150,000 casting cycles or more. The inserts 22 and sub-inserts 24, 26 allow access to tight areas in the die casting apparatus 10 for the coating process and also a weld process. The coating can be formed of various different compositions and by various difference processes. For example, the coating can be applied by nitriding or nitrocarburizing. According to one example embodiment, a nitride coating or a coating applied by a surface treatment sold under the trade name DYNA-BLUE® is applied to the inserts 22 and/or sub-inserts 24, 26. The surface treatment sold under the trade name DYNA-BLUE® is a low temperature ferritic nitrocarburizing surface treatment typically at 950°-1060° F. The DYNA-BLUE® surface treatment yields two, distinct metallurgical characteristics, including a compound layer of 1880 Vickers (75+ Rockwell C) 0.0005"-0.002", and a nitrogen enriched diffusion zone which is 0.002-0.010 inch deep to support the compound zone.

Figure 4:
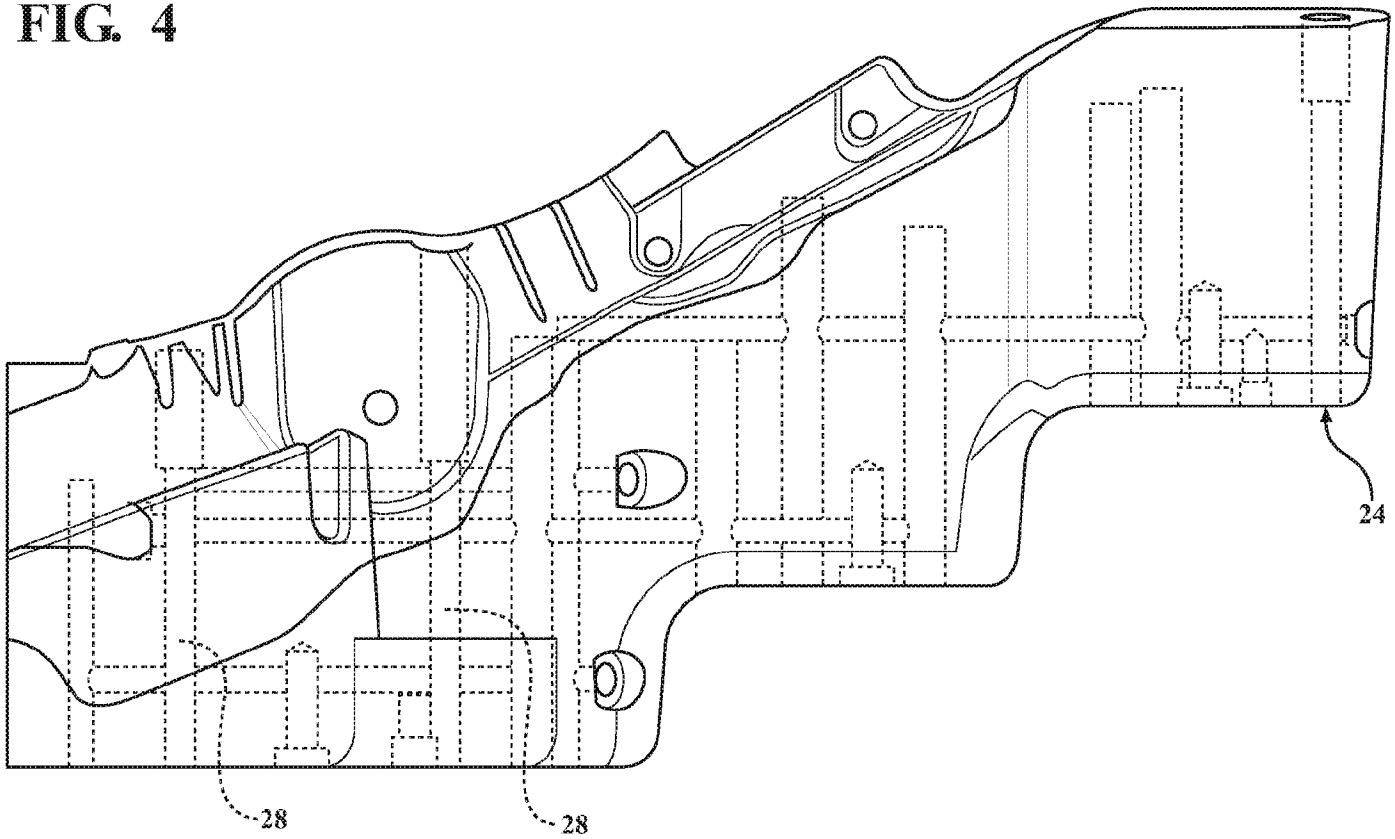
FIG. 4 is a side view of the first sub-insert of FIG. 2 showing cooling lines formed therein.
Figure 5:
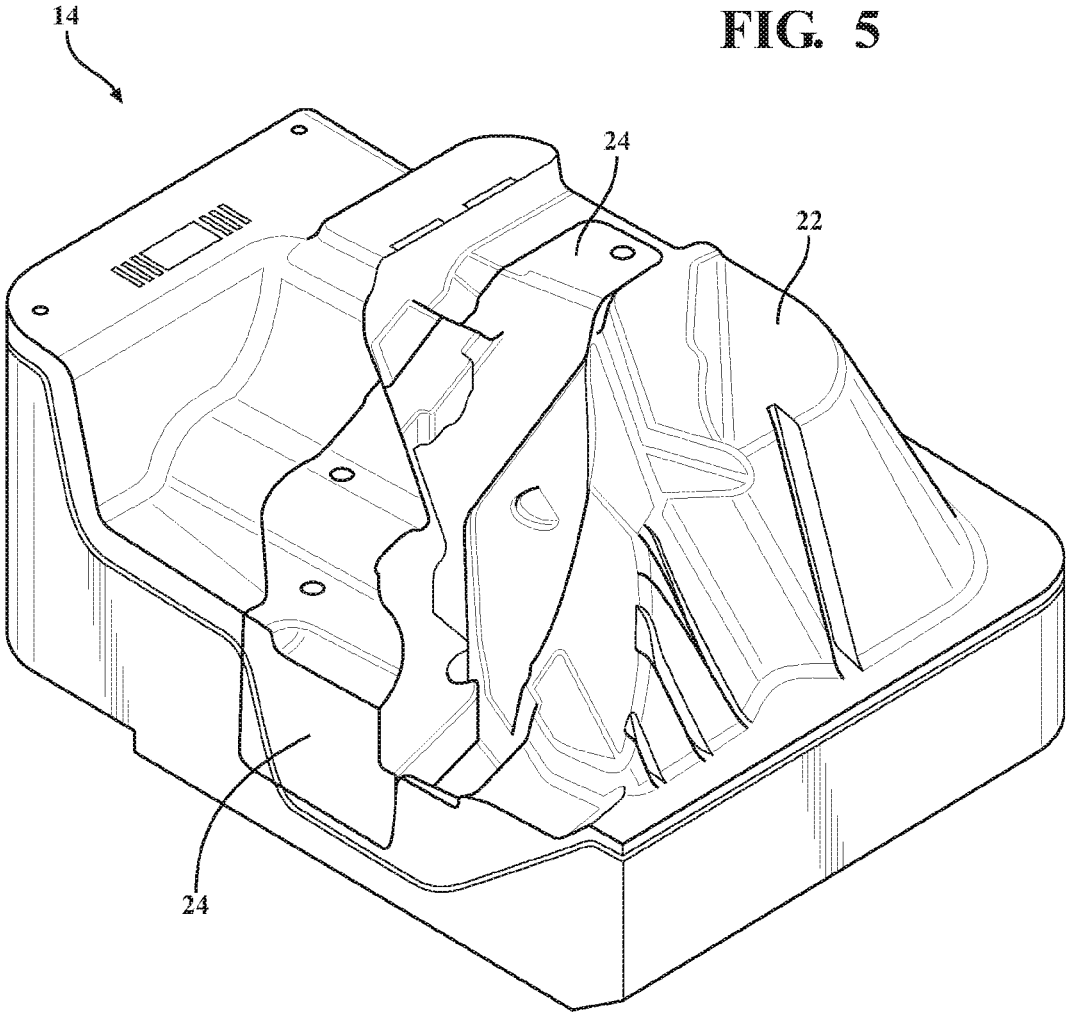
FIG. 5 is a perspective view of the insert and the first sub-insert of FIG. 2.
Figure 6:
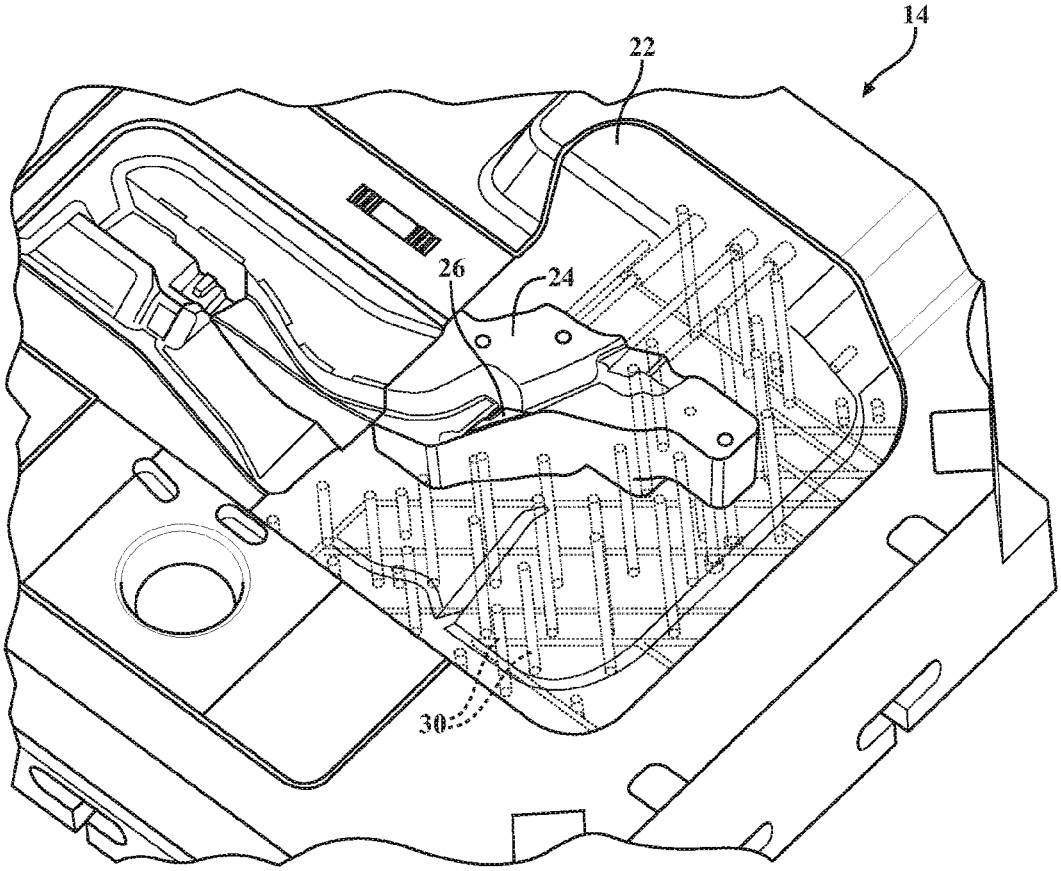
FIG. 6 is a perspective view of the rear rail casting die of FIG. 2 showing cooling lines formed in the insert.

To enhance cooling of the die 12, 14 in critical areas, at least one of the inserts 22 and/or at least one of the sub-inserts 24, 26 can have a self-contained cooling system, such as cooling channels 28, 30 extending therethrough. The cooling channels 28, 30 could have various different shapes and be located in various different locations, depending on the locations of the die 12, 14 prone to heat. In the example embodiments, the insert 22 and the first sub-insert 24 include a plurality of the cooling channels 28, 30 having a cylindrical shape and extending traverse or perpendicular to the forming surfaces 16, 18 for conveying water or another cooling fluid therethrough. FIG. 4 illustrates the cooling channels 28 formed in the first sub-insert 24, and FIG. 6 illustrates the cooling channels 30 formed in the insert 22 according to the example embodiment. The cooling channels 28, 30 reduce the temperature of the casting die 12, 14 during production, which improves cycle time and thus quality of the parts formed.

Another aspect of the invention provides a method of manufacturing the die casting apparatus 10 described above. The method includes providing the upper die 12 and the lower die 14 which form the mold cavity 20 therebetween. At least one of the dies 12, 14 includes at least one insert 22 and/or at least one sub-insert 24, 26. The inserts 22 and sub-inserts 24, 26 form portions of the forming surfaces 16, 18 of the dies 12, 14. The method can also include providing the cooling channels 28, 30 in the inserts 22 and/or sub-inserts 24, 26. The method can optionally include applying the wear and/or heat resistant coating to the inserts 22 and/or sub-inserts 24, 26.

Yet another aspect of the invention provides a method of manufacturing the metal parts, for examples parts used in automotive vehicle applications, using the die casting apparatus 10 described above. The method includes closing the upper die 12 and the lower die 14 to provide the mold cavity 20 therebetween, forcing molten metal into the mold cavity 20 under high pressure, and allowing the molten metal to solidify in the mold cavity 30 to form the metal part. Once the molten metal solidifies, the method includes opening the dies 12, 14 and removing the metal part. These steps can be repeated thousands of times for high volume production. When the inserts 22 or sub-inserts 24, 26 become worn or eroded due to the high temperatures and harsh conditions of the casting process, for example after about 60,000 casting cycles, the inserts 22 and/or sub-inserts 24, 26 can be removed and replaced with new or different inserts 22 and/or sub-inserts 24, 26 to improve the quality of the forming surface 16, 18 used to shape the molten metal. It is no longer necessary to replace the entire die 12, 14, as in prior processes. Thus, the production time and costs is significantly reduced. After replacing the inserts 22 and/or sub-inserts 24, 26, the die casting apparatus 10 can continue casting the metal parts.

Obviously, many modifications and variations of the present invention are possible in light of the above teachings and may be practiced otherwise than as specifically described with within the scope of the invention.

The invention claimed is:

1. A die casting apparatus for manufacturing metal parts, comprising:

an upper die and a lower die providing a mold cavity therebetween, each of said dies presenting a forming surface, at least one of said dies including at least one insert and at least one sub-insert each presenting a portion of said forming surface, said at least one sub-insert being disposed in an area more prone to wear and/or erosion during a casting process than said at least one insert, said at least one insert and said at least one sub-insert being removable from said dies and replaceable.

2. The die casting apparatus of claim 1, wherein a coating is applied to said at least one insert and said at least one sub-insert, and said coating includes nitrogen.

3. The die casting apparatus of claim 2, wherein said coating is applied by nitriding or nitrocarburizing.

4. The die casting apparatus of claim 3, wherein said coating includes a compound zone having a hardness of 1880 Vickers (75+ Rockwell C) at 0.0005 inches to 0.002 inches, and a nitrogen enriched diffusion zone which is 0.002 to 0.010 inches in depth supporting said compound zone.

5. The die casting apparatus of claim 1, wherein at least one of said dies includes a plurality of cooling channels extending through at least one of said inserts and/or at least one of said sub-inserts.

6. The die casting apparatus of claim 5, wherein said cooling channels extend traverse or perpendicular to said forming surfaces.

7. The die casting apparatus of claim 1, wherein each of said sub-inserts is located along one of said inserts or along another one of said sub-inserts.

8. The die casting apparatus of claim 1, wherein a total surface area of said sub-inserts is less than a total surface area of said inserts.

9. The die casting apparatus of claim 1, wherein said dies, said at least one insert, and said at least one sub-insert are formed of steel.

10. The die casting apparatus of claim 1, wherein said metal part to be manufactured is selected from pillars, headers, rails, twist axles, spring links, control arms, bumpers, beams, side panels, strength driven chassis components, body in white components, and safety-related components, said dies are formed of steel, said forming surfaces of said dies have a shape depending on the geometry of said metal part to be manufactured, said at least one insert and said at least one sub-insert are disposed in an area of said dies prone to wear and/or erosion during the casting process, each of said inserts and each of said sub-inserts have a surface area along said forming surface and a thickness extending from said forming surface into said die, said at least one insert and said at least one sub-insert are formed of steel, each of said sub-inserts is located along one of said inserts or along another one of said sub-inserts, a total surface area of said at least one sub-insert is less than a total surface area of said at least one insert, a coating is applied to said at least one insert and said at least one sub-insert, said coating includes nitrogen and is applied by nitriding or nitrocarburizing, at least one of said dies containing said at least one insert and said at least one sub-insert further includes cooling channels for conveying a cooling fluid therethrough, said cooling channels have a cylindrical shape and extend transverse to said forming surface of said die in which said cooling channels are contained, and said cooling channels extend through at least one of said inserts and/or at least one of said sub-inserts.

11. A die casting apparatus for manufacturing metal parts, comprising:

an upper die and a lower die providing a mold cavity therebetween, each of said dies presenting a forming surface, at least one of said dies including at least one insert and at least one sub-insert each presenting a portion of said forming surface, said at least one insert and said at least one sub-insert being removable from said dies and replaceable, and wherein one of said dies includes two of said sub-inserts surrounded by one of said inserts, a first one of said sub-inserts extends longitudinally though a portion of said insert to an edge of said insert, said first sub-insert has a surface area less than a surface area of said insert, a second one of said sub-inserts is disposed along said first sub-insert, and a surface area of said second sub-insert is less than said surface area of said first sub-insert.

12. A method of manufacturing a die casting apparatus for manufacturing metal parts, comprising the steps of:

providing an upper die and a lower die with a mold cavity therebetween, each of the dies presenting a forming surface;

disposing at least one insert and at least one sub-insert in at least one of the dies, the at least one insert and the at least one sub-insert presenting a portion of the forming surface, the at least one sub-insert being disposed in an area more prone to wear and/or erosion during a casting process than the at least one insert;

removing the at least one insert and/or the at least one sub-insert from the dies after about 60,000 casting cycles; and replacing the at least one insert and/or the at least one sub-insert after removing from the dies.

13. The method of claim 12 including applying a coating to the at least one insert and/or the at least one sub-insert, the coating including nitrogen.

14. The method of claim 13, wherein the step of applying the coating includes nitriding or nitrocarburizing.

15. The method of claim 14, wherein the step of applying the coating includes a ferritic nitrocarburizing surface treatment at 950°-1060° F.

16. A method of manufacturing metal parts, comprising the steps of:

casting a plurality of metal parts in a die casting apparatus, the die casting apparatus including an upper die and a lower die providing a mold cavity therebetween, each of the dies presenting a forming surface, at least one of the dies including at least one insert and at least one sub-insert each presenting a portion of the forming surface, the at least one sub-insert being disposed in an area more prone to wear and/or erosion during the casting step than the at least one insert;

removing the at least one insert and/or the at least one sub-insert from the dies after about 60,000 casting cycles; and replacing the at least one insert and/or the at least one sub-insert after removing the at least one insert and/or the at least one sub-insert from the dies.

17. The method of claim 16, wherein the step of casting the plurality of metal parts includes closing the upper die and the lower die to provide the mold cavity therebetween, forcing molten metal into the mold cavity under pressure, allowing the molten metal to solidity in the mold cavity and form the metal part, opening the dies after allowing the molten metal to solidify, and removing the metal part from the dies.

18. The method of claim 16 further including casting a plurality of the metal parts after replacing the at least one insert and/or the at least one sub-insert.

19. The method of claim 16, wherein the metal parts formed during the casting step are selected from pillars, headers, rails, twist axles, spring links, control arms, bumpers, beams, side panels, strength driven chassis components, body in white components, and safety-related components.

20. The method of claim 16, wherein at least one of the dies includes a plurality of cooling channels extending through at least one of the inserts and/or at least one of the sub-inserts, and further including conveying cooling fluid through the cooling channels during the casting step.

* * * * *